US009092001B2

(12) United States Patent
Sato

(10) Patent No.: US 9,092,001 B2
(45) Date of Patent: Jul. 28, 2015

(54) IMAGE FORMING APPARATUS

(71) Applicant: Yuki Sato, Kanagawa (JP)

(72) Inventor: Yuki Sato, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 14/284,434

(22) Filed: May 22, 2014

(65) Prior Publication Data

US 2014/0356021 A1 Dec. 4, 2014

(30) Foreign Application Priority Data

May 31, 2013 (JP) ..... 2013-115912

(51) Int. Cl.
*G03G 21/16* (2006.01)

(52) U.S. Cl.
CPC ..... *G03G 21/1619* (2013.01)

(58) Field of Classification Search
CPC ..... G03G 21/1619
See application file for complete search history.

(56) References Cited

U.S. PATENT DOCUMENTS

| | | | | |
|---|---|---|---|---|
| 6,308,025 | B1 * | 10/2001 | Okano et al. | 399/107 |
| 2011/0102983 | A1 * | 5/2011 | Souda et al. | 361/679.01 |
| 2011/0280614 | A1 * | 11/2011 | Yamauchi et al. | 399/107 |
| 2012/0308243 | A1 * | 12/2012 | Kawasumi | 399/13 |

FOREIGN PATENT DOCUMENTS

| | | |
|---|---|---|
| JP | 1-069241 | 5/1989 |
| JP | 2001-051462 | 2/2001 |

* cited by examiner

*Primary Examiner* — Sandra Brase
(74) *Attorney, Agent, or Firm* — Harness, Dickey & Pierce, P.L.C.

(57) ABSTRACT

An image forming apparatus includes an apparatus body, first legs, a second leg, a first member, a second member, and a third member. The first legs and the second leg are disposed on a bottom portion of the apparatus body. The first member has a width greater than a height to form a large horizontal surface. Each of the second member and the third member has a height greater than a width to form a large vertical surface. The apparatus body has a first side to arrange two of the first legs, and a second side opposite the first side to arrange the second leg. The first, second, and third members are arranged on the top of the first side, an upper side surface of the second side, and a lower side surface of the second side, respectively.

6 Claims, 7 Drawing Sheets

IMAGE FORMING APPARATUS

CROSS-REFERENCE TO RELATED APPLICATIONS

This patent application is based on and claims priority pursuant to 35 U.S.C. §119(a) to Japanese Patent Application No. 2013-115912, filed on May 31, 2013, in the Japan Patent Office, the entire disclosure of which is hereby incorporated by reference herein.

BACKGROUND

1. Technical Field

Exemplary aspects of the present invention relate to an electrophotographic image forming apparatus such as a copier, a facsimile machine, and a scanner, and more particularly, to the structure of the frame of the electrophotographic image forming apparatus body.

2. Related Art

An image forming apparatus generally includes a frame for reinforcement, for example, a side-plate-frame type and a resin-made integration type. In an image forming apparatus with the side-plate-frame type, image forming components and conveyance components are supported by two side plates spaced a certain distance apart and connected by a member for reinforcement, with legs disposed on the bottom thereof, arranged in a known arrangement.

In such a frame, side plates, posts, and stays are arranged in locations according to convenience of an internal layout of the image forming apparatus, although the side plates, the posts, and the stays need to reinforce the image forming apparatus. Such an arrangement is designed without checking whether the arrangement contributes to the strength of the image forming apparatus. Consequently, such an arrangement may make the frame heavier due to shape of a component and an unnecessary member that contribute little or nothing to strengthen the body, which is the basic function of the frame.

SUMMARY

In at least one embodiment of this disclosure, there is provided an image forming apparatus including an apparatus body, first legs, a second leg, a first member, a second member, and a third member. The apparatus body includes a sheet feed unit having a sheet feed roller. The first legs are disposed on a bottom portion of the apparatus body. The second leg is disposed on the bottom portion of the apparatus body. The first member has a width greater than a height to form a large horizontal surface. The second member has a height greater than a width to form a large vertical surface. The third member has a height greater than a width to form a large vertical surface. The apparatus body has a first side parallel to the axis of the sheet feed roller on which two of the first legs are provided with a first distance therebetween. The apparatus body has a second side opposite the first side on which the second leg is provided. The first member is arranged on a top surface of the first side. The second member is arranged on an upper side surface of the second side. The third member is arranged on a lower side surface of the second side.

In at least one embodiment of this disclosure, there is provided an image forming apparatus including an apparatus body, first legs, second legs, a first member, a second member, and a third member. The apparatus body includes a sheet feed unit having a sheet feed roller. The first legs are disposed on a bottom portion of the apparatus body. The second legs are disposed on the bottom of the apparatus body. The first member has a width greater than a height to form a large horizontal surface. The second member has a height greater than a width to form a large vertical surface. The third member has a height greater than a width to form a large vertical surface. The apparatus body has a first side parallel to the axis of the sheet feed roller on which two of the first legs are provided with a first distance therebetween. The apparatus body has a second side opposite the first side on which two of the second legs are provided with a second distance shorter than the first distance therebetween. The first member is arranged on a top surface of the first side. The second member is arranged on an upper side surface of the second side. The third member is arranged on a lower side surface of the second side.

BRIEF DESCRIPTION OF THE DRAWINGS

The aforementioned and other aspects, features, and advantages of the present disclosure will be better understood by reference to the following detailed description when considered in connection with the accompanying drawings, wherein.

Figure 1:
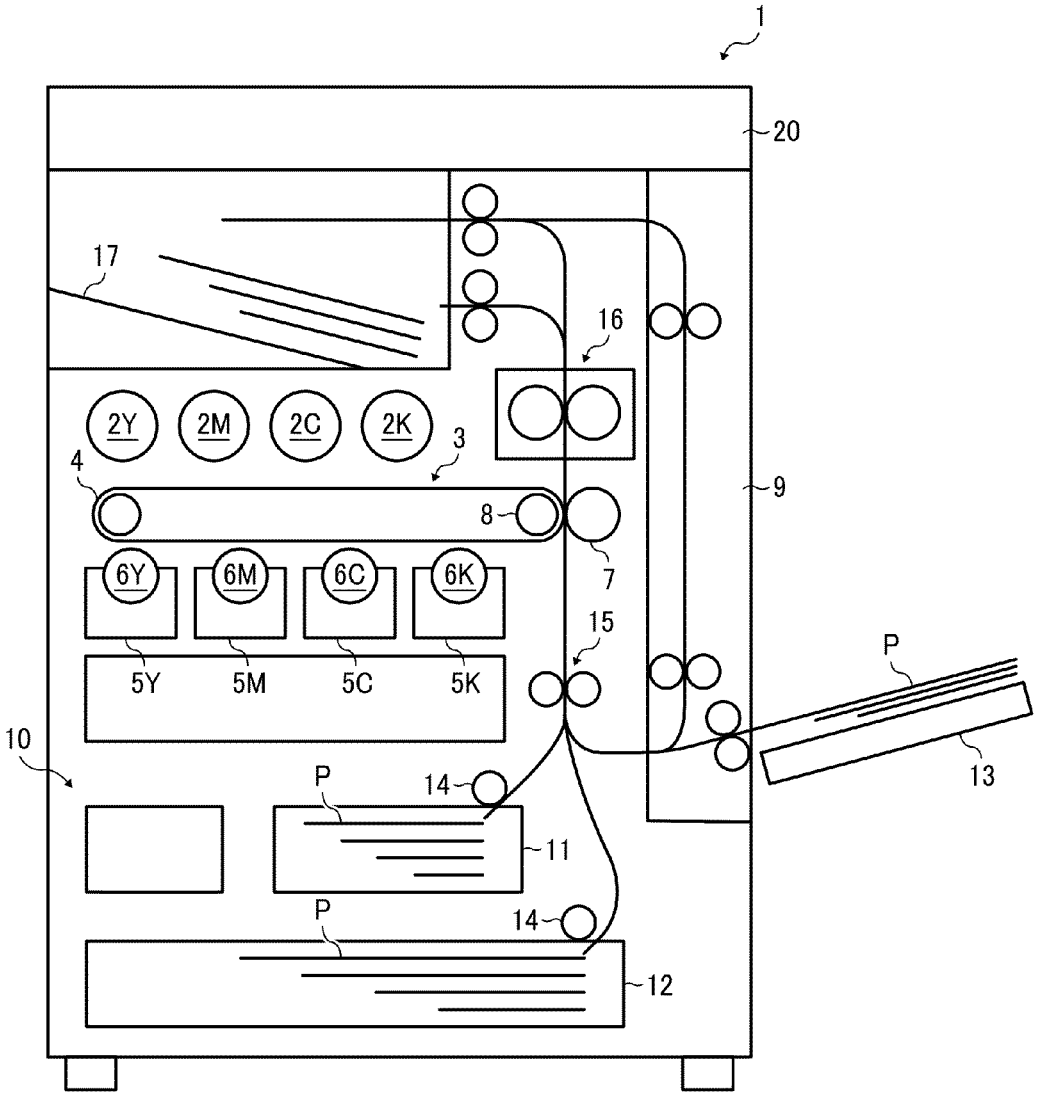
FIG. 1 is a schematic front view of an image forming apparatus according to an exemplary embodiment of the present invention.

The accompanying drawings are intended to depict exemplary embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that have the same function, operate in a similar manner, and achieve similar results.

Although the exemplary embodiments are described with technical limitations with reference to the attached drawings, such description is not intended to limit the scope of the invention and all of the components or elements described in the exemplary embodiments of this disclosure are not necessarily indispensable to the present invention.

Referring now to the drawings, exemplary embodiments of the present disclosure are described below. In the drawings, the same reference signs are allocated to elements (members or components) having the same function or shape and redundant descriptions thereof are omitted below.

FIG. 1 illustrates an image forming apparatus 1 according to an exemplary embodiment of the present invention. In FIG. 1, the image forming apparatus 1 serving as a full-color copier includes an apparatus body 9 and a scanner 20. The apparatus body 9 of the image forming apparatus 1 houses four developer cartridges 2Y, 2M, 2C, and 2K for respective colors of yellow, magenta, cyan, and black. The developer cartridges 2Y, 2M, 2C, and 2K are detachably disposed in a cartridge storage unit arranged in an upper portion of the apparatus body 9 of the image forming apparatus 1. The scanner 20 for reading a document is disposed on top of the apparatus body 9.

An intermediate transfer unit 3 is disposed below the cartridge storage unit. The intermediate transfer unit 3 includes an intermediate transfer belt 4. Image forming units 5Y, 5M, 5C, and 5K for the respective colors include photosensitive drums 6Y, 6M, 6C, and 6K, respectively. The photosensitive drums 6Y, 6M, 6C, and 6K serving as latent image carriers are disposed opposite the intermediate transfer belt 4. Since each of the image forming units 5Y, 5M, 5C, and 5K is substantially similar to every other except for the color of toner therein, and each of the photosensitive drums 6Y, 6M, 6C, and 6K is also substantially similar to every other except for the color of toner, the color abbreviations are hereinafter omitted for the sake of simplicity.

Each of the image forming units 5 includes a charge unit, a development unit, a cleaning unit, a discharge unit, and the photosensitive drum 6. The charge unit, the development unit, the cleaning unit, and the discharge unit are disposed around the photosensitive drum 6. Accordingly, a series of image forming processes (a charging process, an exposure process, a development process, a transfer process, and a cleaning process) is performed on each of the photosensitive drums 6. Thus, YMCK images are formed on the respective photosensitive drums 6.

In FIG. 1, each of the photosensitive drums 6 is rotated clockwise by a drive motor. A surface of the photosensitive drum 6 is uniformly charged in a position of the charge unit (the charging process). Subsequently, the surface of the photosensitive drum 6 reaches an exposure position where an exposure device irradiates the surface of the photosensitive drum 6 with a laser beam. Hence, an electrostatic latent image is formed on the surface of the photosensitive drum 6 by exposure scanning (the exposure process). Then, as the photosensitive drum 6 rotates, the portion of the surface of the photosensitive drum 6 bearing the latent image reaches a position opposite a development device. In this position, the development device develops the electrostatic latent image formed on the surface of the photosensitive drum 6, thereby forming a toner image (the development process). The surface of the photosensitive drum 6 then reaches a position opposite the intermediate transfer belt 4 and a first transfer roller, so that the toner image on the photosensitive drum 6 is transferred to the intermediate transfer belt 4 (a primary transfer process). Herein, the surface of the photosensitive drum 6 has a little amount of remaining toner that is not transferred to the intermediate transfer belt 4. When the surface of the photosensitive drum 6 reaches a position opposite the cleaning unit, the remaining toner is collected from surface of the photosensitive drum 6 by the cleaning unit (the cleaning process). Lastly, when the surface of the photosensitive drum 6 reaches a position opposite the discharge unit, a residual potential is removed from the surface of the photosensitive drum 6. Accordingly, a series of the image forming processes on the photosensitive drum 6 is completed.

Meanwhile, the toner images of the respective colors are formed on the respective photosensitive drums 6 by the development process, and the resultant images are superimposed and transferred to the intermediate transfer belt 4. Upon reaching a position opposite a secondary transfer roller 7, the intermediate transfer belt 4 is nipped at a secondary transfer nip formed between a secondary backup roller 8 and the secondary transfer roller 7. The four-color toner image formed on the intermediate transfer belt 4 is transferred to a recording medium P such as a transfer sheet conveyed to the position of the secondary transfer nip. Herein, the intermediate transfer belt 4 has a remaining toner that is not transferred to the recording medium P. When the intermediate transfer belt 4 reaches a belt cleaning unit, the remaining toner is collected from the intermediate transfer belt 4 by the belt cleaning unit. Accordingly, a series of transfer processes on the intermediate transfer belt 4 is completed.

A recording medium P is conveyed to the position of the secondary transfer nip from at least one of sheet feed trays 11 and 12 and a manual feed tray 13 through a roller such as a feed roller 14 and a registration roller pair 15. The sheet feed trays 11 and 12 are disposed in a sheet feed unit 10 arranged in a lower portion of the apparatus body 9. In each of the sheet feed trays 11 and 12 of the sheet feed unit 10, a plurality of recording media Ps are stacked and stored. When the feed roller 14 is rotated counterclockwise in FIG. 1, one recording medium P stacked on the top of the plurality of recording media Ps is fed toward the registration roller pair 15. When the recording medium P is conveyed to the registration roller pair 15, the conveyance of the recording medium P temporarily stops in a nipping position between the registration roller pair 15 being not rotated. When the registration roller pair 15 is rotated to time with the color image on the intermediate transfer belt 4, the recording medium P is conveyed toward the secondary transfer nip. In the position of the secondary transfer nip, the color image on the intermediate transfer belt 4 is transferred to a surface of the recording medium P.

Subsequently, the recording medium P with the transferred color image is conveyed to a fixing unit 16. In the fixing unit 16, a fixing roller and a pressure roller apply heat and pressure to the color image transferred to the surface of the recording medium P, thereby fixing the color image on the recording medium P. Then, the recording medium P is discharged as an output image to a discharge tray 17 provided at a predetermined discharge position. Accordingly, a series of image forming processes in the image forming apparatus 1 is completed.

Figure 2:
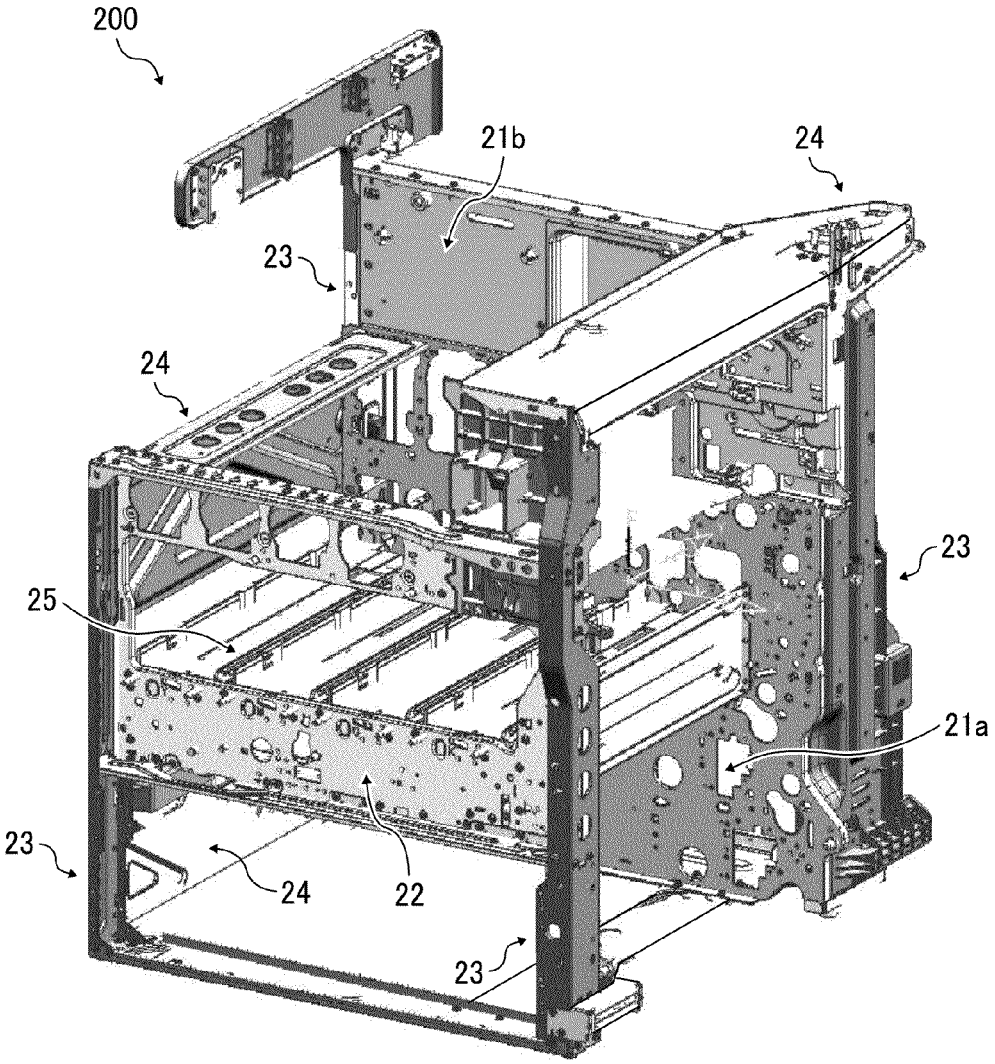
FIG. 2 is a schematic perspective view of a frame of the image forming apparatus according to the exemplary embodiment of the present invention.

FIG. 2 illustrates the structure of a frame 200 of the apparatus body 9 of the image forming apparatus 1. In FIG. 2, the frame 200 includes two rear side plates 21*a* and 21*b*, a front side plate 22, a plurality of supporting posts 23, and a plurality of stays 24. In the present exemplary embodiment, four supporting posts 23 are disposed to receive vertical weight, whereas three stays 24 are disposed to maintain the relative positions of the two rear side plates 21*a* and 21*b*, the front side plate 22, and the supporting posts 23. The rear side plate 21*a* is integrated with a guide plate of the fixing unit 16 by using resin. In a related-art frame structure, a board is arranged below sheet feed trays. By contrast, in FIG. 2, the frame 200 according to the exemplary embodiment of the present invention does not need to have a board below the sheet feed tray 11 or 12, although arrangement of a reinforcing plate is needed. Moreover, the frame 200 illustrated in FIG. 2 includes guide rails 25 used to remove and insert the image forming units 5.

With such an internal structure, each of the plates extending across the four supporting posts 23 barely affects the strength of the frame, and is mainly used for registration of the image forming units 5.

Figure 3:
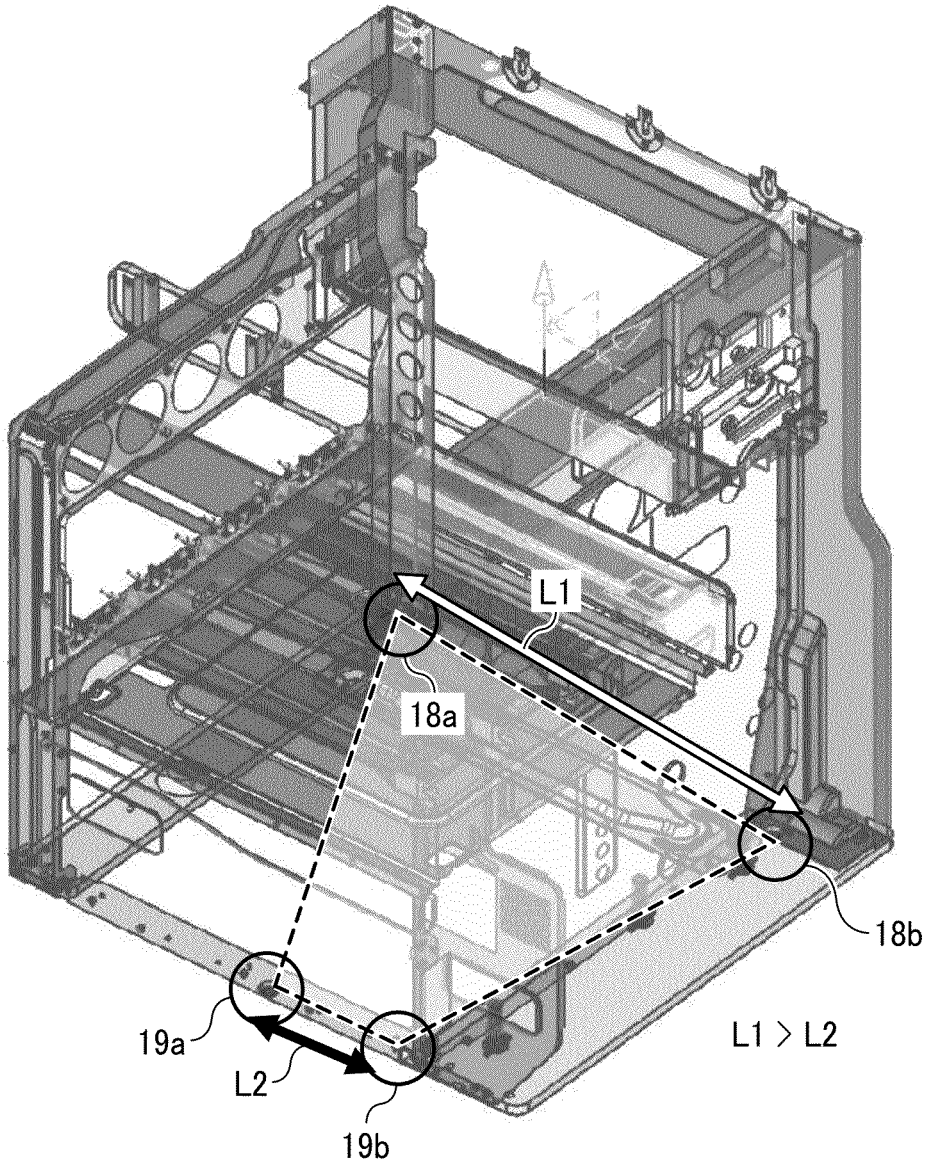
FIG. 3 is a schematic bottom perspective view of the frame of the image forming apparatus according to the exemplary embodiment of the present invention.

FIG. 3 is a schematic view of the frame 200 illustrated in FIG. 2 as seen from the bottom. The frame 200 of the apparatus body 9 includes two first legs 18*a* and 18*b* and two second legs 19*a* and 19*b*. Each of the first legs 18*a* and 18*b* and the second legs 19*a* and 19*b* is arranged in an area indicated by a circle in FIG. 3. At a side at which the feed roller 14 of the apparatus body 9 is disposed, the two first legs 18*a* and 18*b* are arranged below the front side plate 22 and the rear side plates 21*a* and 21*b*. The two second legs 19*a* and 19*b* are arranged on a side opposite the first legs 18*a* and 18*b*. The two first legs 18*a* and 18*b* have a distance L1 therebetween, whereas the two second legs 19*a* and 19*b* have a distance L2 therebetween shorter than the distance L1. Hence, the frame includes a total of four legs 18*a*, 18*b*, 19*a*, and 19*b* that form a trapezoid as shown in FIG. 3.

Figure 7:
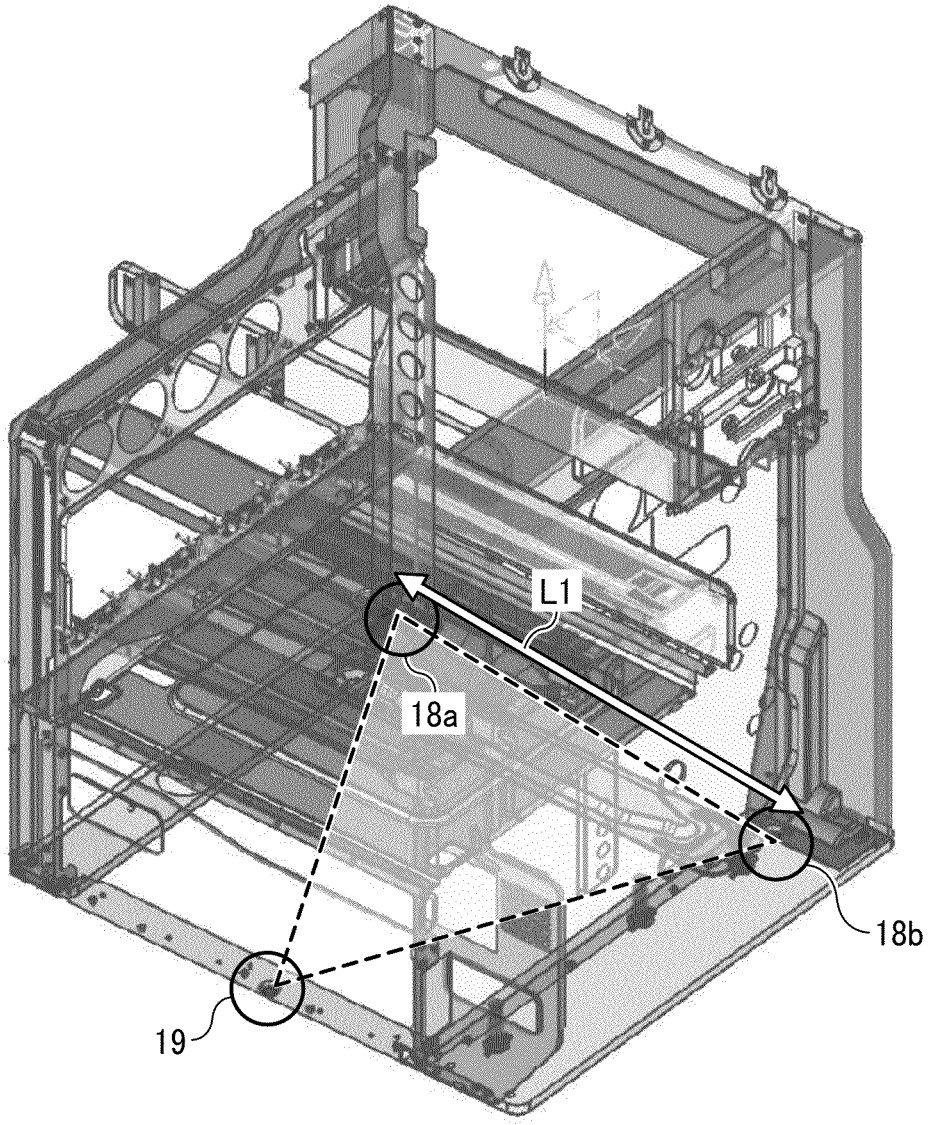
FIG. 7 is a schematic bottom perspective view of a frame of an image forming apparatus according to an exemplary embodiment of the present invention.

Alternatively, the distance L2 may be zero as illustrated in FIG. 7 according to a frame of an image forming apparatus according to an exemplary embodiment of the present invention. In such a case, one second leg 19 and two first legs 18*a* and 18*b* form a triangle on the ground. The two first legs 18*a* and 18*b* and the one second leg 19 are arranged in substantially a triangle, so that the frame of an apparatus body 9 is not affected by an installation surface on which the apparatus body 9 is installed. Such a method is generally used. That is, even if the installation surface has some unevenness, the substantially triangular arrangement of the legs 18*a*, 18*b*, and 19 enables the legs 18*a*, 18*b*, and 19 to be stable on the installation surface.

In the exemplary embodiments of the present invention, the trapezoidal or triangular arrangement of the legs restricts a twist of the frame. The feed roller 14 is disposed on the right side of the apparatus body 9 illustrated in FIG. 3, and the distance L1 between the two first legs 18*a* and 18*b* is relatively long on the right side of the apparatus body 9. Since the distance L1 is relatively long, the right side of the apparatus body 9 is stable. Moreover, with the distance L2 between the two legs 19*a* and 19*b* near the rear side plates 21*a* and 21*b*. a side of the apparatus body 9 at which the rear side plates 21*a* and 21*b* are arranged is stable. As a result, the left front side of the apparatus body 9 is lifted as illustrated in an area indicated by a circle A shown in FIG. 4.

Figure 4:
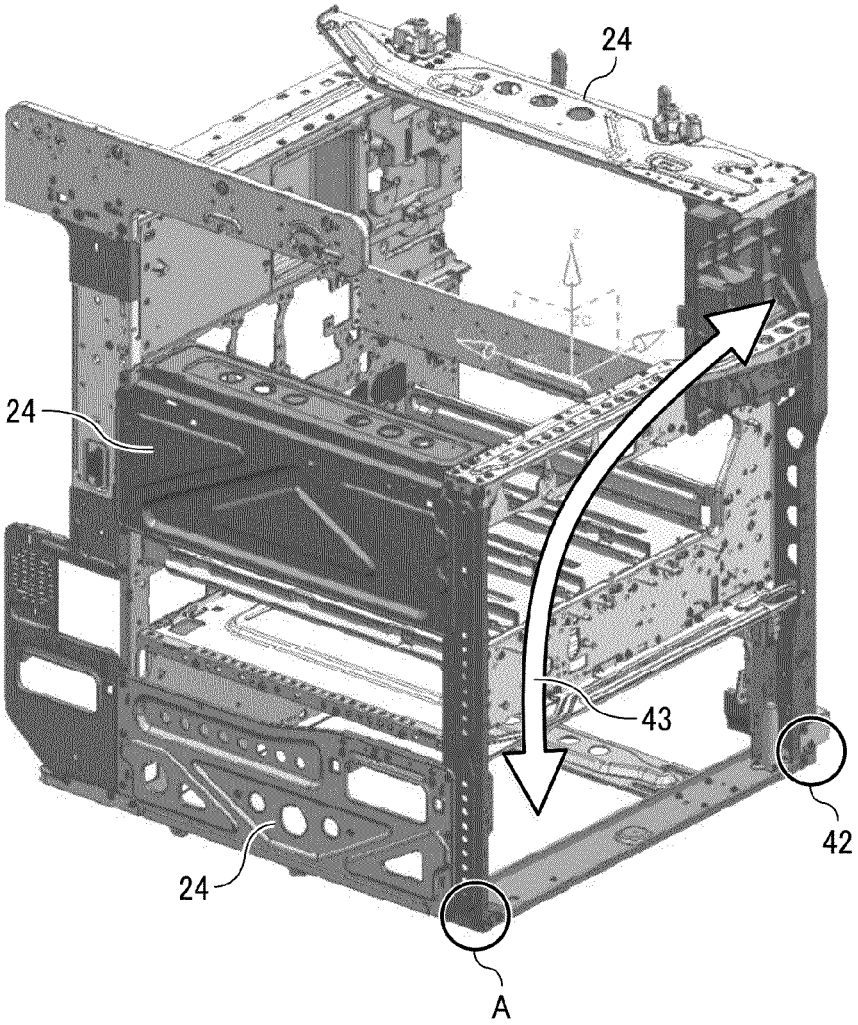
FIG. 4 is a schematic perspective view of the frame of the image forming apparatus according to the exemplary embodiment of the present invention.

Thus, in FIG. 4, frame deformation caused by the twist of the frame is limited by the front side plate 22 which is twisted around a fulcrum in a restrictive manner. The fulcrum is indicated by a circle 42 shown in FIG. 4. The twist of the frame is indicated by an arrow 43 shown in FIG. 4.

According to the exemplary embodiments of the present invention, therefore, the image forming apparatus 1 has a suitable configuration including arrangement and shape of the components to restrict the twist of the frame of the apparatus body 9 and eliminate the deformation of the frame of the apparatus body 9.

As illustrated in FIG. 2, in the vicinity of the installation surface, there is no stay disposed on two of the supporting posts 23 arranged at a side at which the distance L1 between the two first legs 18*a* and 18*b* is provided. That is, the stay 24 is not disposed in a position of a feed port including the feed roller 14. The absence of the stay 24 in this position facilitates maintenance work such fixing a sheet jam. A recording medium P fed from any of the sheet feed trays 11 and 12 by the feed roller 14 is conveyed in a vertical direction, and an image is formed by each of the image forming units 5. Then, the recording medium P with the toner image is discharged on the discharge tray 17 disposed on an upper portion of the apparatus body 9.

Figure 5:
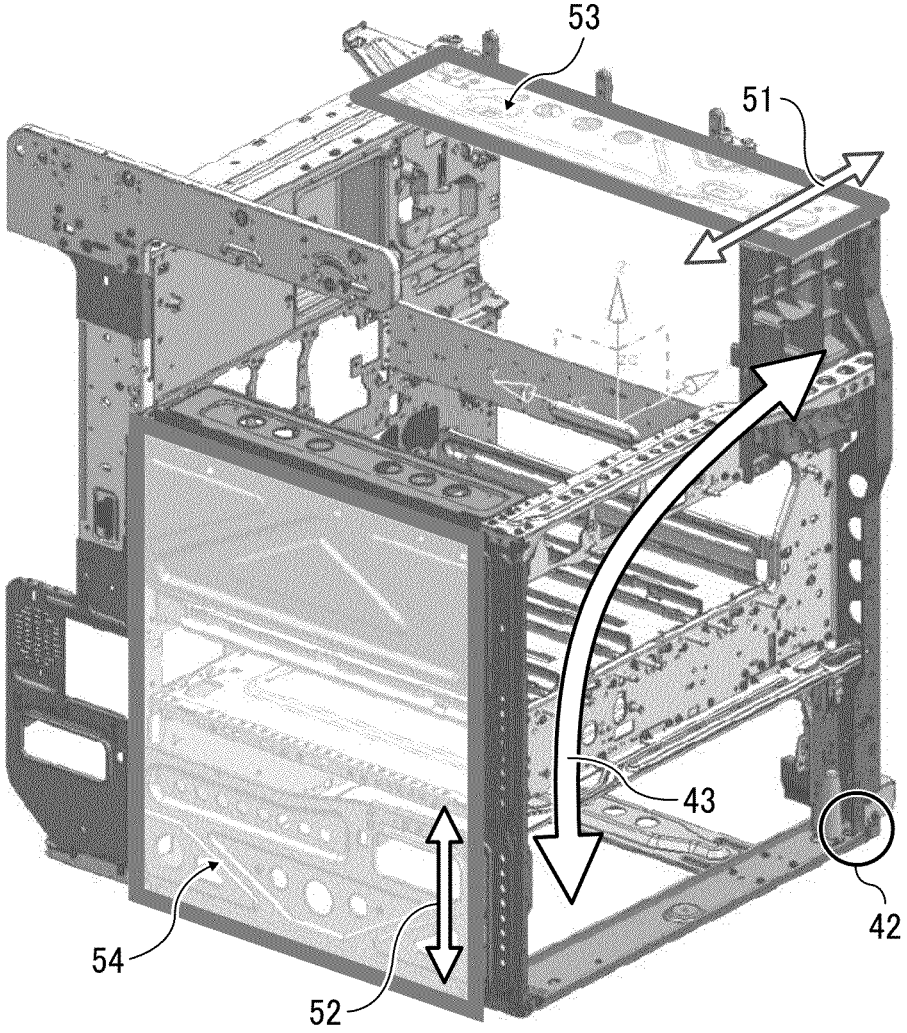
FIG. 5 is another schematic perspective view of the frame of the image forming apparatus according to the exemplary embodiment of the present invention.

FIG. 5 illustrates an arrangement of members for eliminating the twist of the frame illustrated in FIG. 4. In the present exemplary embodiment, since the frame is twisted in the direction indicated by the arrow 43, the twist of the frame may be eliminated by disposing members that form a horizontal surface 53 and a vertical surface 54. The horizontal surface 53 is arranged in a horizontal direction 51 on the top surface of the apparatus body 9, whereas the vertical surface 54 is arranged in a vertical direction 52 on the left side of the apparatus body 9.

Generally, a stressed skin structure (a monocoque structure) has resistance to twist and distortion. Since the stressed skin structure does not require extra structural materials, the weight of the structure can be reduced. However, in a case where excess stress is locally applied to a portion in the stressed skin structure, the local portion may be deformed and damaged more easily. Since the image forming apparatus 1 must be able to withstand twist and distortion from a functional standpoint, the stressed skin structure may be suitable for the image forming apparatus 1. That is, in comparison with a structure in which stays are disposed inside, the stressed skin structure is more suitable for the image forming apparatus 1 to maintain the mechanical rigidity of the image forming apparatus 1. In addition, the twist can be eliminated more easily from a position further from a fulcrum based on the leverage theory.

Accordingly, the stays 24 should be suitably disposed in portions near an outer side of the apparatus body 9 to connect the four supporting posts 23. In such a case, the horizontal surface 53 on the top surface of the apparatus body 9 should be suitably enlarged to deal with deformation that occurs in the direction 51. Moreover, the vertical surface 54 on the left side of the apparatus body 9 should be suitably enlarged to deal with deformation that occurs in the direction 52.

Figure 6:
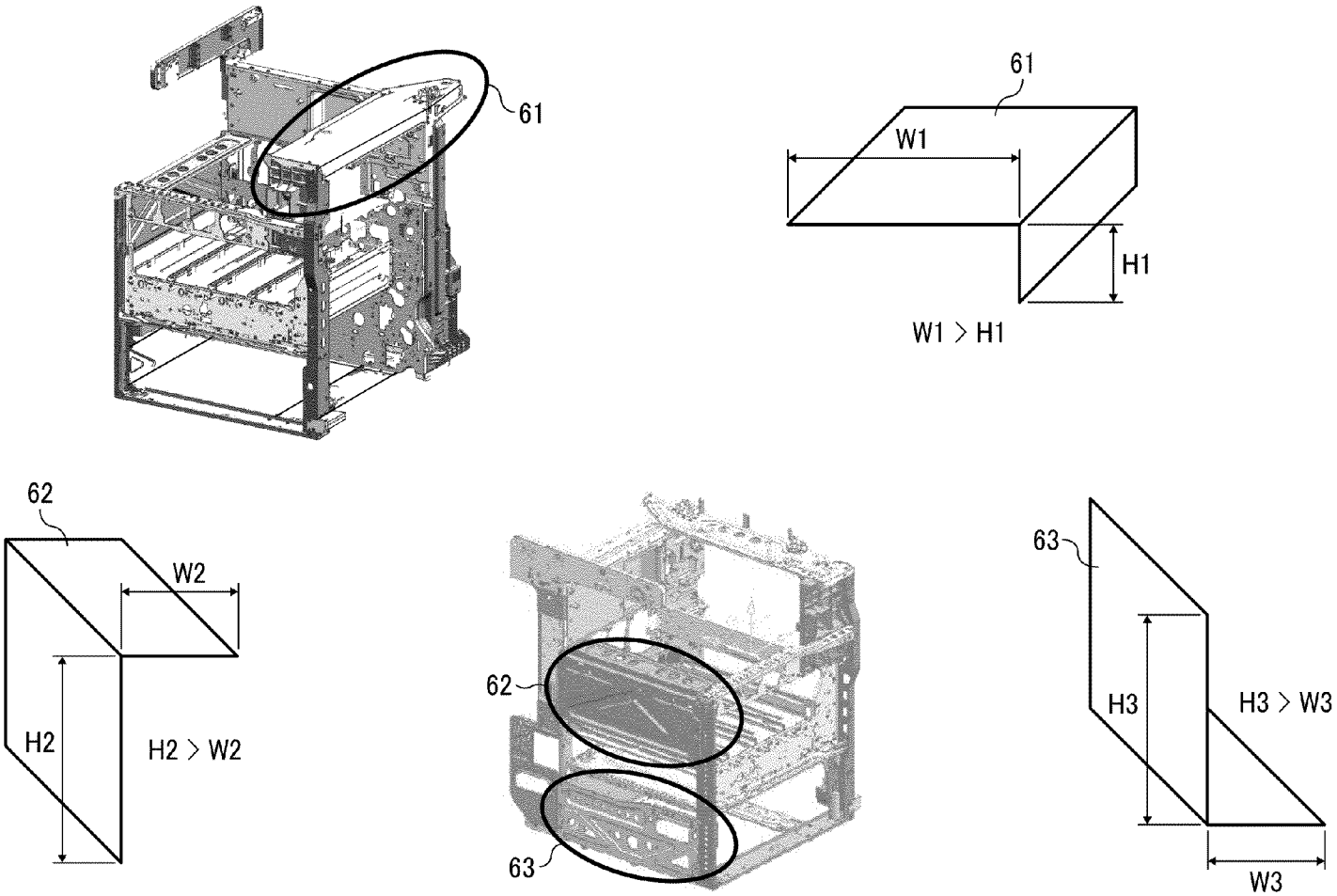
FIG. 6 is a schematic view of a first member through a third member in a frame of an image forming apparatus according to another exemplary embodiment of the present invention.

FIG. 6 illustrates a first member 61, a second member 62, and a third member 63 used to eliminate a twist of a frame of an image forming apparatus according to another exemplary embodiment. The image forming apparatus according to the present exemplary embodiment is substantially the same as the image forming apparatus 1 including the frame illustrated in FIG. 5 except for the members forming the horizontal surface 53 and the vertical surface 54 illustrated in FIG. 5. Components and configurations that differ from those of the exemplary embodiment illustrated in FIG. 5 will be described, and like components will be given the same reference numerals as above and description thereof will be omitted.

The first member 61 is arranged to connect top portions of two supporting posts 23 disposed at a side at which a distance L1 between two first legs 18*a* and 18*b* is provided.

The first member 61 has a large horizontal surface. The first member 61 has a width W1 that is greater than a height H1. The second member 62 is arranged to connect top portions of the other two supporting posts 23 disposed at a side at which a distance L2 between two second legs 19*a* and 19*b* is provided. The second member 62 has a large vertical surface. The second member 62 has a height H2 that is greater than a width W2. The third member 63 is arranged to connect bottom portions of the two supporting posts 23 at a side at which the distance L2 between the second legs 19*a* and 19*b* is provided. The third member 63 has a large vertical surface. The third member 63 has a height H3 that is greater than a width W3.

As for each of the first, second, and third members 61, 62, and 63, any member having a certain strength may be used.

However, according to the present exemplary embodiment, the use of the first, second, and third members 61, 62, and 63 has reduced an average plate thickness from approximately 1.0 mm to approximately 0.6 mm. Such reduction in the plate thickness can reduce the weight of the image forming apparatus 1 by approximately 20% in comparison with a related-art image forming apparatus. The first, second, and third members 61, 62, and 63 are engaged with the supporting posts 23 by screws.

According to the exemplary embodiment of the present invention, therefore, the first member 61, the second member 62, and the third member 63 serving as reinforcing members are suitably arranged. Such a suitable arrangement enables the apparatus body 9 of the image forming apparatus 1 to achieve strength that is substantially the same as that achieved by a related-art arrangement although the number of members used in the arrangement according to the present exemplary embodiment of the present invention is smaller than that used in the related-art arrangement. Consequently, the exemplary embodiment of the present invention can reduce the weight and costs of the image forming apparatus 1. In the exemplary embodiment, the second member 62 and the third member 63 are two separate members. Alternatively, the second member 62 and the third member 63 may be integrated together.

With the above structure, the scanner 20 is generally disposed above one portion or the entire portion of the horizontal surface of the first member 61. In such a general layout, the bottom of the scanner 20 may serve as the first member 61, thereby further reducing the number of components and the weight of the image forming apparatus 1. In the above structure, moreover, an electric substrate may be arranged above the first member 61. In such a case, a holding member that holds the electric substrate may serve as the first member 61, thereby further reducing the number of components and the weight of the image forming apparatus 1.

In the exemplary embodiments, the color copier is described as an image forming apparatus. However, the exemplary embodiments of the present invention are not limited to the color copier. The exemplary embodiments of the present invention may be applied to an image forming apparatus such as a monochrome copier, a printer, a plotter, a facsimile machine, and a multifunctional peripheral.

The present invention has been described above with reference to specific exemplary embodiments. Note that the present invention is not limited to the details of the embodiments described above, but various modifications and enhancements are possible without departing from the spirit and scope of the invention. It is therefore to be understood that the present invention may be practiced otherwise than as specifically described herein. For example, elements and/or features of different illustrative exemplary embodiments may be combined with each other and/or substituted for each other within the scope of the present invention.

What is claimed is:

1. An image forming apparatus, comprising:

an apparatus body including a sheet feed unit having a sheet feed roller;

first legs disposed on a bottom portion of the apparatus body;

a second leg disposed on the bottom portion of the apparatus body;

a first member having a width greater than a height to form a large horizontal surface;

a second member having a height greater than a width to form a large vertical surface; and a third member having a height that is greater than a width to form a large vertical surface, the apparatus body having a first side parallel to the axis of the sheet feed roller on which two of the first legs are provided with a first distance therebetween, the apparatus body having a second side opposite the first side on which the second leg is provided, the first member arranged on a top surface of the first side, the second member arranged on an upper side surface of the second side, and the third member arranged on a lower side surface of the second side.

2. The image forming apparatus according to claim 1, further comprising a scanner having a bottom constituted by at least a portion of the horizontal surface of the first member.

3. The image forming apparatus according to claim 1, further comprising a holding member holding an electric substrate, the holding member constituted by at least a portion of the horizontal surface of the first member.

4. An image forming apparatus, comprising:

an apparatus body including a sheet feed unit having a sheet feed roller;

first legs disposed on a bottom portion of the apparatus body;

second legs disposed on the bottom of the apparatus body;

a first member having a width greater than a height to form a large horizontal surface;

a second member having a height greater than a width to form a large vertical surface; and a third member having a height greater than a width to form a large vertical surface, the apparatus body having a first side parallel to the axis of the sheet feed roller on which two of the first legs are provided with a first distance therebetween, the apparatus body having a second side opposite the first side on which two of the second legs are provided with a second distance shorter than the first distance therebetween, the first member arranged on a top surface of the first side, the second member arranged on an upper side surface of the second side, and the third member arranged on a lower side surface of the second side.

5. The image forming apparatus according to claim 4, further comprising a scanner having a bottom constituted by at least a portion of the horizontal surface of the first member.

6. The image forming apparatus according to claim 4, further comprising a holding member holding an electric substrate, the holding member constituted by at least a portion of the horizontal surface of the first member.

* * * * *